US005249744A

United States Patent [19]

Ruthenberg

[11] Patent Number: 5,249,744

[45] Date of Patent: Oct. 5, 1993

[54] APPARATUS FOR CREATING WATERFALL FOR SWIMMING POOLS

[76] Inventor: Douglas Ruthenberg, 10453 Tillery Rd., Spring Hill, Fla. 34608

[21] Appl. No.: 924,203

[22] Filed: Aug. 3, 1992

[51] Int. Cl.[5] ..... B05B 1/36; B05B 17/08

[52] U.S. Cl. ..... 239/23; 239/17; 239/193; 239/211; 239/590.5

[58] Field of Search ..... 239/17, 19, 20, 22, 239/23, 193, 211, 590, 590.5

[56] References Cited

U.S. PATENT DOCUMENTS

| | | | |
|---|---|---|---|
| 3,211,378 | 10/1965 | Zysk | 239/211 X |
| 3,409,223 | 11/1968 | Gosh | 239/23 X |
| 3,901,439 | 8/1975 | Willis | 239/20 X |
| 4,202,056 | 5/1980 | Watkins | 239/17 X |
| 4,836,142 | 6/1989 | Duback | 239/23 X |
| 4,881,280 | 11/1989 | Leskar | 239/20 X |
| 4,886,210 | 12/1989 | Gaffney et al. | 239/193 |
| 5,115,974 | 5/1992 | Tobias et al. | 239/193 X |
| 5,167,368 | 12/1992 | Nash | 239/17 |

FOREIGN PATENT DOCUMENTS

| | | | |
|---|---|---|---|
| 2641802 | 3/1978 | Fed. Rep. of Germany | 239/193 |
| 28808 | 6/1989 | Japan | 239/590.5 |
| 2185541 | 7/1987 | United Kingdom | 239/17 |
| 9206788 | 4/1992 | World Int. Prop. O. | 239/193 |

*Primary Examiner*—Andres Kashnikow
*Assistant Examiner*—William Grant
*Attorney, Agent, or Firm*—Joseph C. Mason, Jr.; Ronald E. Smith

[57] ABSTRACT

A natural waterfall is simulated by introducing water into an inlet box that includes a spreader for dividing the incoming stream into two laterally flowing streams that are reflected off the sidewalls of the inlet box and which collide against each other to suppress the turbulence of the incoming stream in the absence of baffle walls. The inlet box has an outlet in open communication with an outlet box through which the water flows to create the waterfall. In a second embodiment, an open-faced structure includes a back wall, side walls, and a bottom wall, and the waterfall apparatus is positioned against the back wall so that its outlet faces the open front end of the structure. Rocks are then added to fill the structure. The walls of the structure constrain the water to flow down the face of the rocks. This enables a rock waterfall to be built by inexperienced personnel.

8 Claims, 3 Drawing Sheets

APPARATUS FOR CREATING WATERFALL FOR SWIMMING POOLS

BACKGROUND OF THE INVENTION

1. Field of the Invention

This invention relates, generally, to devices that produce a waterfall effect at the side of a swimming pool or other landscaping feature such as an artificial rocky cliff. More particularly, it relates to a device that spreads water laterally into a thin sheet to simulate a natural waterfall.

2. Description of the Prior Art

U.S Pat. No. 4,881,280 to Lesikar, entitled "Waterfall Producing Unit For Use In Swimming Pools," shows a device that produces a very smooth waterfall. It employs a deep chamber that receives water from the swimming pool pump, a throat that extends from the deep chamber to the water outlet, a plurality of baffle walls in the throat, and a weir between the deep chamber and the throat. All of these features are supplied to suppress the turbulence of the water exiting the throat to create the simulated waterfall. More specifically, the depth of the deep chamber allows the turbulent incoming water to settle down before it enters the throat of the device. Moreover, the weir that separates the deep chamber from the throat ensures that only a thin layer of water can enter the throat at any one time, and the baffle walls in the throat suppress any residual splashing that may occur therein. The result is a very stable sheet of water that flows from the throat.

In a second embodiment of the Lesikar device, the deep chamber is eliminated and a series of baffle walls is relied upon to suppress splashing and to produce an even film of water. That embodiment has not been seen in commercial models, but it is believed that its arrangement of parts would produce a waterfall having more turbulence than the deep chamber embodiment.

A device that delivers a simulated waterfall to a bathtub is shown in U.S. Pat. No. 4,334,328 to Delepine. However, unlike the Lesikar device, it relies upon two laterally spaced apart sources of water to achieve the lateral spread of water required in a simulated waterfall.

The problem with deep well waterfall-simulating devices of the type first invented by Lesikar is that they must be installed at the time the pool is built because they are too large for retrofit applications. Moreover, such devices are mechanically complex and require substantial assembly time. The art would be advanced if a simple-in-structure and therefore easy to manufacture waterfall creating device could be invented. The ideal device would also have a low profile so that it could be retrofit into existing pools.

Another problem in the swimming pool industry relating to waterfalls is the difficulty of constructing rock waterfalls that will flow as desired down a preselected pathway. The seemingly simple construction task of stacking rocks in a mound and directing water over a preselected side thereof to create a waterfall is anything but simple. Since water finds the path of least resistance, it flows downwardly in unexpected ways, often flowing in a reverse manner such that the resulting waterfall cannot be seen by an observer stationed in front of the rock pile. It often takes years of experience before a waterfall builder can stack the rocks just right to force the water to follow a desired path of travel.

Thus, there is a need in the industry for a structure that could ease the task of rock waterfall construction.

The ideal innovation would enable inexperienced workers to build successful waterfalls without going through a time-consuming trial and error procedure.

However, when the teachings and suggestions of the prior art are considered as a whole, it is clear that the invention of the ideal devices needed to fulfill the extant needs would not have been obvious to those of ordinary skill in this art at the time the invention disclosed hereinafter was made.

SUMMARY OF THE INVENTION

The first embodiment of the present invention is embodied by a shallow box of parallelepiped construction and an even more shallow box that extends therefrom coincident with the top thereof. The smaller box has an open end from which water emerges, and the larger box has an opening in a back wall or a bottom wall that provides a water inlet. Those skilled in the art to which this invention pertains will presume, if a reasonably smooth waterfall is to be produced, that a rather large plurality of baffle walls of the type shown in the Lesikar patent must be positioned within both boxes.

However, a smooth waterfall is produced by the present invention in the absence of a plurality of baffle walls. The insight of this invention that eliminates reliance on a deep chamber and baffle walls to quell turbulence and to spread the water into a waterfall-like stream is that the water may be caused to calm itself by causing it to collide with itself. A single part is positioned in the larger box, centrally thereof, to divide the incoming water into two oppositely flowing streams that are reflected back into one another by the sidewalls of the larger box. The single part is a stream-dividing, splash-suppression device and includes an imperforate top Wall and a pair of imperforate side walls that depend from opposite edges thereof at an outwardly diverging angle relative to one another. The lowermost edges of the diverging sidewalls are positioned above the imperforate bottom wall of the larger box by a distance substantially equal to the depth of the shallow box, and the forward and rearward ends of the splash suppression device are closed by the forward and rearward sidewalls of the larger box, respectively.

Water from the swimming pool pump enters the splash suppression device either from an inlet formed in the bottom wall of the larger box or from an inlet formed in the rearward wall of said larger box. The only requirement is that inlet water is constrained to enter the waterfall-creating apparatus at the splash suppression device.

In a second embodiment of the invention, a structure is provided that enables unskilled workers to build a waterfall of the type that runs down the face of a rock pile. The structure includes an upstanding back wall, a pair of diverging sidewalls connected to opposite ends of the back wall, and a bottom wall. A waterfall apparatus of the type disclosed in the first embodiment of the invention is positioned at the rear of the novel structure, with its back wall disposed in abutting relation to the upstanding back wall of the structure, and rocks are then used to fill the structure. Reverse flow of water is prevented by the structure's walls, and a freely flowing waterfall down the forward face of the rock pile is easily achieved in the absence of substantial trial and error.

The primary object of this invention is to provide a waterfall-creating device characterized by irreducible structural simplicity.

A more specific object is to advance the art of such devices by disclosing a unique splash-suppressing device that harnesses the power of the Water itself to quell turbulence within the incoming stream of water.

Another important object is to advance the art of rook waterfall construction by providing a structure that facilitates such construction and which lowers the skill required to build a rock waterfall.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
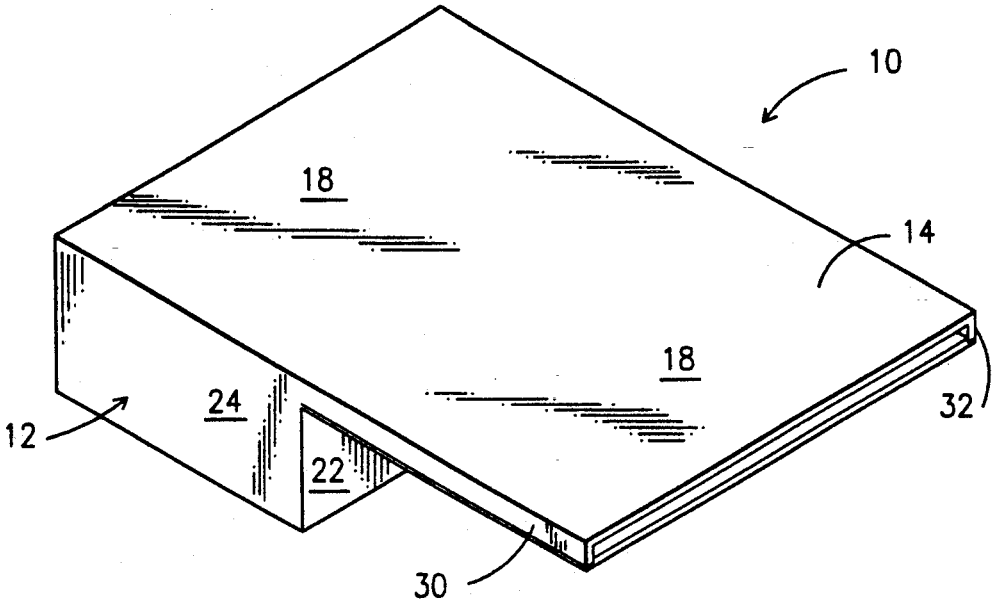
FIG. 1 is a perspective view of an illustrative embodiment of the novel apparatus.

Referring now to the drawings, it will there be seen that an exemplary embodiment of the invention is denoted as a whole by the reference numeral 10.

The larger box is denoted 12 as a whole and the smaller box is denoted 14 as a whole. As will become more clear as this description proceeds, both boxes, in the preferred embodiment, share a common top wall and thus are not, strictly speaking, separate boxes, but conceptualization of the invention is aided by thinking of the apparatus in terms of a larger box and a smaller one. The larger box will hereinafter be referred to as the inlet box to better describe its function and the smaller box will be referred to as the outlet box for the same reason.

Figure 3:
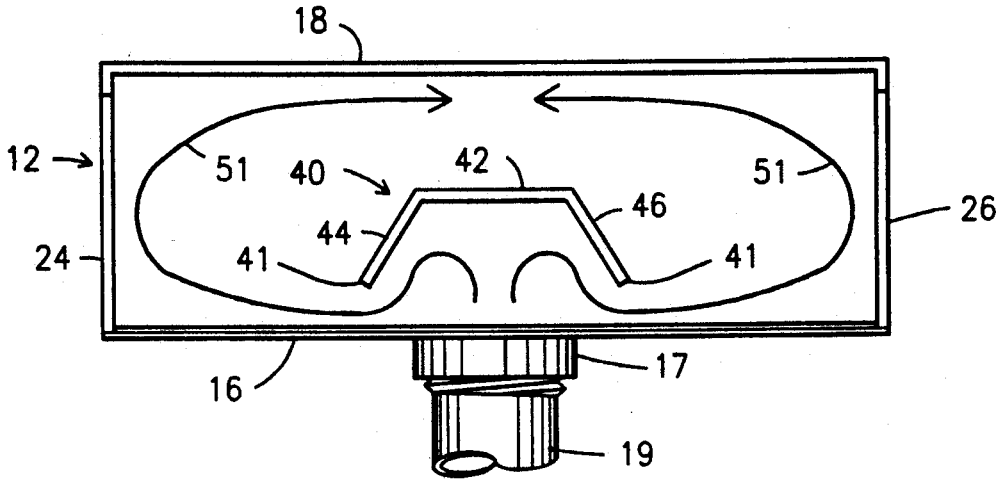
FIG. 3 is a front elevational view of the larger box when its front wall is removed, showing how the splash-surpressing device controls the flow of water through the novel apparatus.
Figure 4:
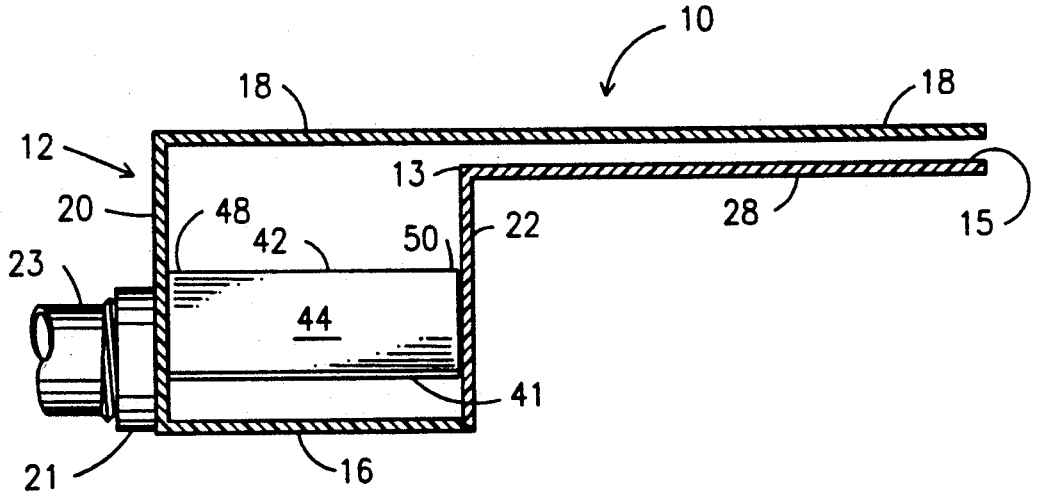
FIG. 4 is a longitudinal sectional view of the device, showing an alternate positioning of the incoming water pipe.

As perhaps best shown in FIGS. 3 and 4, inlet box 12 includes bottom wall 16, top wall 18, rear wall 20, front wall 22 and side walls 24, 26. Outlet box 14 includes bottom wall 28 (FIG. 4), top wall 18 (which it shares with inlet box 12 as aforementioned), and side walls 30, 32 (FIG. 1); it has no rear wall and no front wall as shown in FIG. 4 and thus may also be thought of as a chute having a closed top.

A coupling 17 (FIG. 3) is connected to an opening formed in bottom wall 16, or, alternatively, a coupling 21 (FIG. 4) may be connected to an opening formed in rear wall 20; inlet water from the swimming pool pump, not shown, is admitted into device 10 at said coupling 17 or 21 through inlet water pipes 19 or 23, respectively. Thus, the inlet water arrives in a columnar flow; in the absence of a water spreading means, the waterfall created thereby would include a concentration of water in the center thereof.

Front wall 22 of inlet box 12 has less vertical extent than rear wall 20 of said box as perhaps best shown in FIG. 4; more particularly, the uppermost extent of said front wall is coincident with the plane of the bottom wall 28 of outlet box 14. This creates a second opening in inlet box 12 that provides fluid communication between the inlet box and the outlet box.

More particularly, outlet box 14 has a first open end 13 disposed in open communication with said second opening and said outlet box further has a second open end 15 from which water falls to create the desired waterfall effect.

Figure 2:
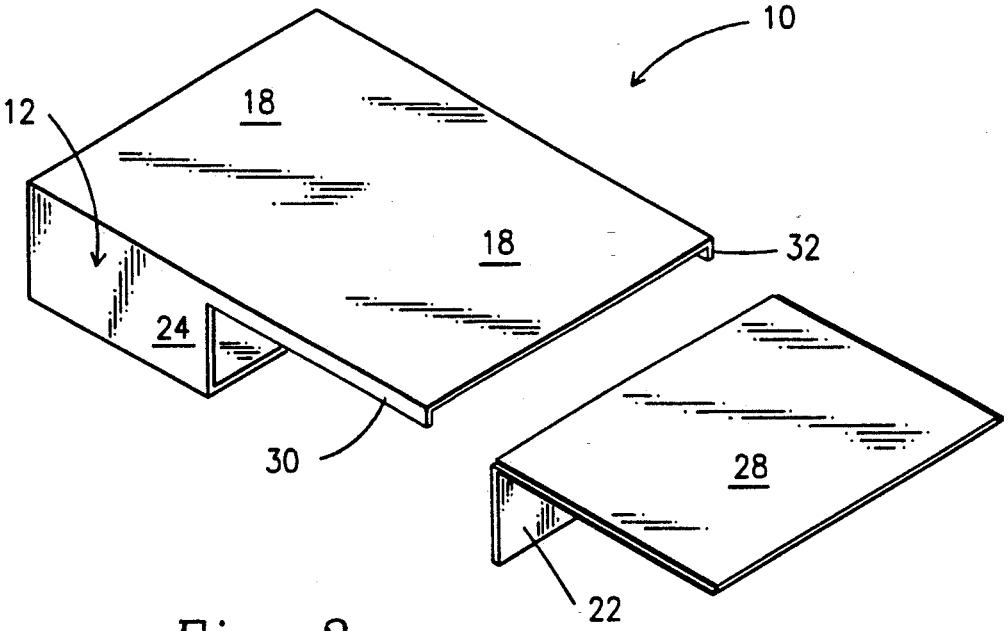
FIG. 2 is an exploded perspective view of the FIG. 1 embodiment.

In the preferred embodiment, the front wall 22 of the inlet box and the bottom wall 28 of the outlet box are formed integrally with one another, as shown in FIGS. 2 and 4, are disposed normal to one another as shown, and meet at the uppermost edge of the front wall and the rearmost or trailing edge of the bottom wall. Moreover, in said preferred embodiment, the integrally formed part made up of said front wall 22 and said bottom wall 28 is detachable from the balance of the parts that make up the invention, as best shown in FIG. 2; this eases both the manufacturing and the assembling processes but is not critical to the invention.

FIG. 3 shows the means for spreading the incoming column of water into a thin, laterally spread out sheet of water and for suppressing the splashing of said water. Spreader 40 includes an imperforate top wall 42 disposed in a substantially horizontal plane and a pair of side walls, 44 and 46, that depend from opposite sides thereof at a predetermined angle, in diverging relation to one another. The trailing end 48 of spreader 40, as shown in FIG. 4, is fixedly secured to rear wall 20, i.e., the trailing end of spreader walls 42, 44, and 46 abut rear wall 20 are secured thereto by suitable means. Similarly, the leading end 50 of spreader 40 abuts front wall 22 when device 10 is assembled and is similarly secured thereto by suitable means.

Note that the lowermost edges 41 of spreader 40 are spaced above bottom wall 16 by an amount substantially equal to the spacing between the top and bottom walls 18, 28 of the outlet box 14. Note also, in FIG. 3, the central positioning of the spreader relative to the sidewalls 24 and 26.

Accordingly, water entering either coupling 17 or 21 is constrained by spreader 40 to flow in the path of travel indicated by directional arrows 51 (FIG. 3), i.e., about half of the water is constrained to flow under the lowermost edge 41 of spreader side wall 44, and the other half thereof is constrained to flow under lowermost edge 41 of spreader side wall 46. The turbulent surging of the water as it enters either coupling 17 or 21 is initially suppressed by spreader 40. Moreover, since the water is constrained to enter inlet box 12 at the bottom thereof, the water already in said box overlies the incoming water and thus acts as a further turbulence-suppressing means.

As device 10 operates, water exits inlet box 12 by flowing through outlet box 14 until it exits said outlet box at its open leading end 15 to form the waterfall. Since the depth of the outlet box is substantially the same as the depth of the water flowing laterally from spreader 40, the inlet box 12 will be continuously filled with water during the time the waterfall is operating; this suppresses the turbulence of the water before it reaches the outlet box as aforesaid. Since the water flows laterally in the large box, it is spread laterally as it enters the outlet box. More particularly, the depth of the water exiting the outlet box is substantially the same across the breadth thereof. In the absence of spreader 40, most of the water would be bunched toward the center of the exit of the outlet box, as mentioned earlier, and only a trickle of water would exit said outlet box at its outermost edges.

It should also be observed that water exiting the spreader 40 initially impinges upon the side walls 24, 26 of inlet box 12, and is reflected therefrom back toward the center of the box, as indicated by directional arrows 51 as aforesaid. Thus, the water traveling toward the center of the box from sidewall 24 meets and collides with the water flowing towards said center from sidewall 26. This collision occurs substantially in the center of the inlet box, i.e., directly above the longitudinal axis of top wall 42 of spreader 40, when both streams of water are flowing at their fastest rate, and thus the collision greatly attenuates the turbulence of the water. Accordingly, the unique spreader 40 results in inlet box 12 filling with calm, nearly splashless water. Thus, the waterfall itself is quite calm across its breadth, even though the depth of the inlet box 12 is relatively shallow compared to the depth of the inlet boxes of the prior art. Whereas the devices heretofore known relied upon baffle walls and a deep inlet box in combination with a weir to smooth out the waterfall, the present invention harnesses the energy of the water itself to smooth itself out, i.e., the converging streams of water eliminate the need for the deep inlet box, the weir, and the plurality of baffle walls relied upon by said earlier devices. No collisions of water flowing in opposite directions are created in the earlier devices; in the absence of such collisions, the aforesaid structures were required, all of which have been eliminated by this invention.

Figure 5:
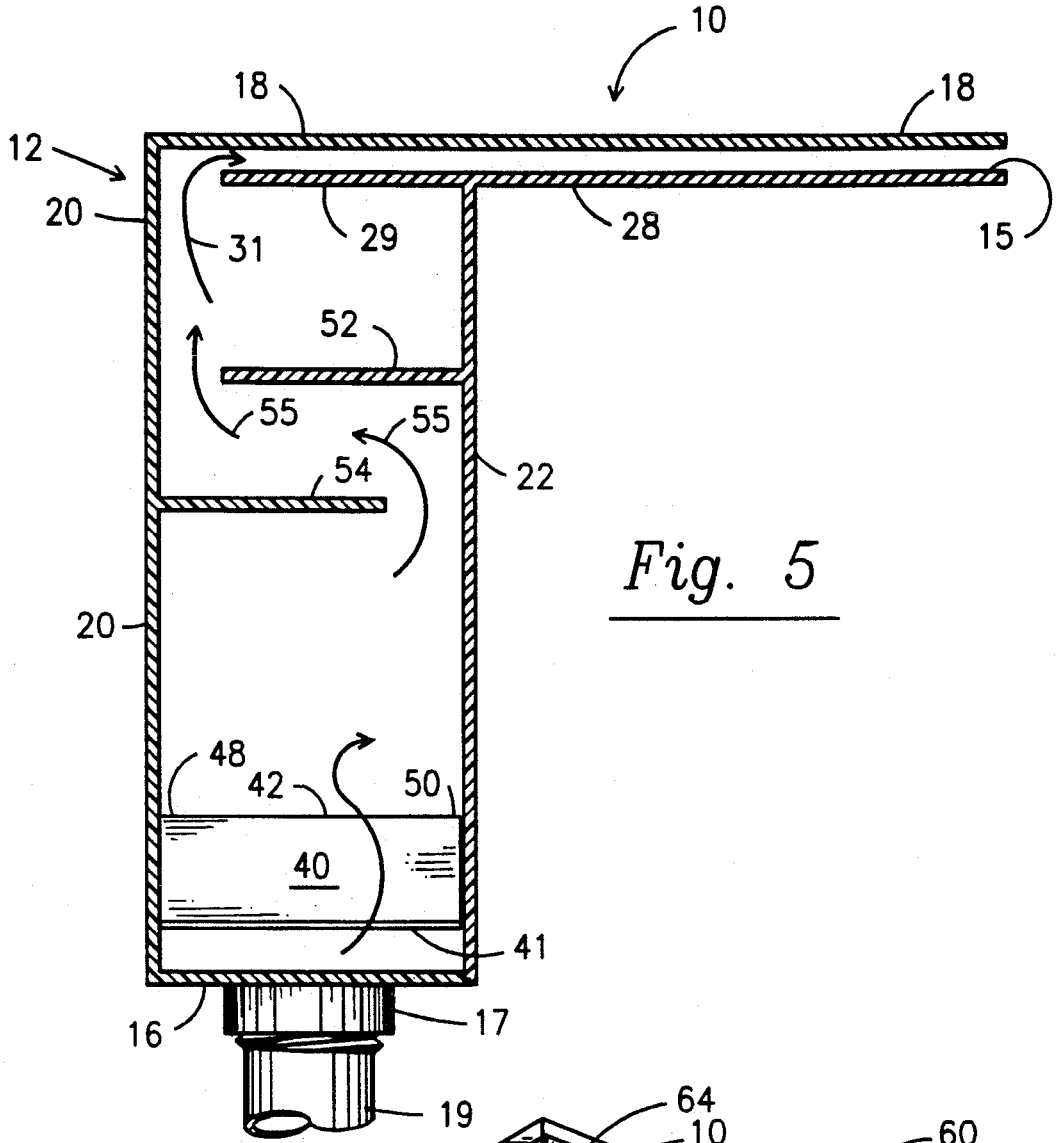
FIG. 5 is a side elevational view of an alternative embodiment of the novel apparatus.

An alternative embodiment of the present invention is depicted in FIG. 5; the same reference numerals are applied to its parts, because its structure is quite similar to the first-described embodiment. However, note that bottom wall 28 has an inwardly extending part 29 that was not provided in the first embodiment. This constrains water, indicated by arrow 31 in said Fig., to enter the outlet box 14 through the small opening shown, thereby suppressing turbulence even further.

It has been found that when the devices of FIGS. 1-5 are made to provide very wide waterfalls, the water exiting open end 15 may be uneven. For very wide constructions only, baffle walls 52,54 are provided. They constrain the water within the device to follow the path of travel indicated by directional arrows 55. The baffle walls 55 extend the entire width of the device, but the effect of evenly distributed water in the waterfall is achieved independently of the vertical spacing between said walls 52,54 and independently of the vertical positioning of said walls, i.e., the only requirement is that said walls be spaced from one another somewhere between inwardly extending wall 29 and top wall 42 of spreader 40.

Figure 6:
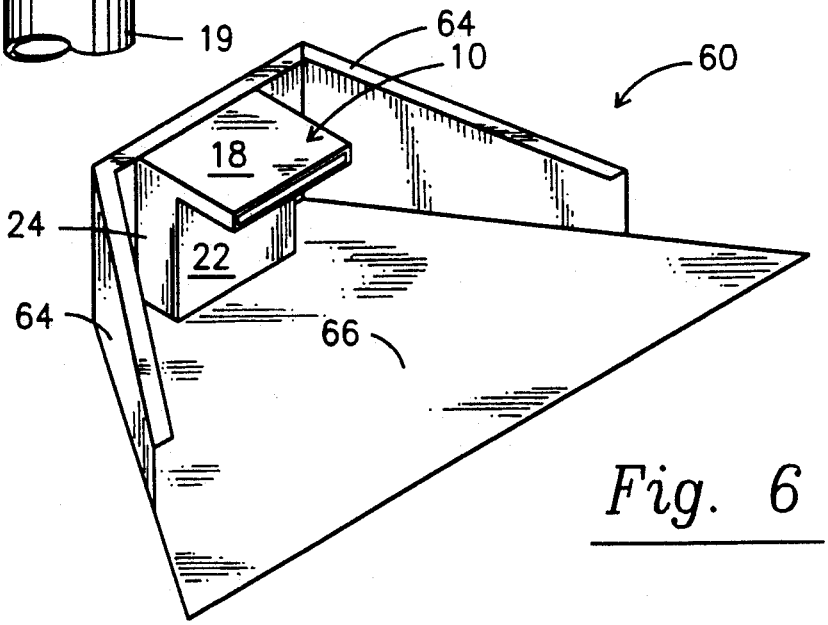
FIG. 6 is a perspective view of the novel structure for building a rock waterfall.

FIG. 6 shows the structure having utility as a waterfall-defining structure; it is denoted 60 as a whole. Structure 60 includes an upstanding, transversely disposed, imperforate back wall 62, imperforate side walls 64,64 that are secured to opposite ends of said back wall and which project forwardly therefrom in diverging relation to one another, and imperforate bottom wall 66. By merely positioning waterfall device 10 with its rear wall 20 in abutting, centered relation to back wall 62 of the structure 60, and by filling the structure with rooks, a functioning rock waterfall can be built quickly by untrained personnel; the water will flow down the forward face of the pile, i.e., where it can be observed as desired. Any undesired rearward flow is blocked by the walls of the structure, and diverted back toward the open front end of the structure.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An apparatus for changing a columnar flow of incoming water from a water inlet pipe into a shallow stream of water having a predetermined breadth greater than the breadth of said inlet pipe so that a waterfall effect is created, comprising:

an inlet box including a top wall, a bottom wall, a front wall, a back wall, and a pair of side walls;

said inlet box having a first opening formed in a predetermined wall thereof so that water from said inlet pipe may enter said inlet box;

said inlet box having a second opening formed in a predetermined wall thereof so that water may exit therefrom;

an outlet box having a top wall, a bottom wall, a pair of side walls, a first open end and a second open end;

said outlet box first open end being connected to said second opening of said inlet box;

said inlet box having a depth greater than said outlet box;

a spreader member positioned in said inlet box for suppressing turbulence of said incoming water and for spreading said columnar flow of water into said predetermined breadth;

said spreader member being positioned substantially centrally of said inlet box and in closely spaced relation to said bottom wall thereof;

said spreader member splitting said incoming water into two streams of laterally flowing water that flow, initially, in opposite directions;

said spreader member having an imperforate top wall and a pair of imperforate sidewalls that depend from opposite edges of said top wall, said spreader member extending between said front and rear walls of said inlet box, and said sidewalls of said spreader member having lowermost edges spaced upwardly of said bottom wall of said inlet box by a predetermined distance;

whereby said two streams of laterally flowing water collide with one another after reflecting off said sidewalls of said inlet box, said collision suppressing said turbulence.

2. The apparatus of claim 1, further comprising a pair of baffle walls disposed within said inlet box in vertically spaced relation to one another, said baffle walls having a width equal to the width of said inlet box, and said baffle walls being disposed below said outlet box and above said spreader member to produce an even waterfall when said inlet box and outlet box are very wide.

3. The apparatus of claim 2, wherein said inlet box top wall and said outlet box top wall are integrally formed with one another so that said inlet box and said outlet box have a common top wall.

4. The apparatus of claim 3, wherein said inlet box front wall has less vertical extent than said inlet box rear wall, and wherein said inlet box front wall is formed integrally with said outlet box bottom wall.

5. The apparatus of claim 4 wherein said inlet box front wall and said outlet box bottom wall are formed integrally with one another.

6. The apparatus of claim 5, wherein said sidewalls of said spreader member depend from opposite edges of said spreader member top wall at a predetermined angle, in diverging relation to one another.

7. The apparatus of claim 6, wherein lowermost edges of said sidewalls of said spreader member are spaced from said inlet box bottom wall by a distance substantially equal to the distance between the top and bottom walls of said outlet box.

8. The apparatus of claim 1, further comprising:

a structure, for use in conjunction with said apparatus, for facilitating construction of a rock waterfall;

said structure including an upstanding, imperforate back wall;

said structure including a pair of imperforate side walls secured to opposite ends of said back wall of said structure and projecting in a common direction therefrom in diverging relation to one another; and said structure including an imperforate bottom wall; whereby rocks charged into said structure are retained therewithin; and whereby positioning said back wall of said inlet box in abutting relation to said back wall of said structure and said bottom wall of said inlet box in overlying relation to said bottom wall of said structure prior to charging said rocks into said structure produces a functioning rock waterfall.

* * * * *